US011286569B2

(12) United States Patent
Tippetts et al.

(10) Patent No.: US 11,286,569 B2
(45) Date of Patent: Mar. 29, 2022

(54) RECONTAMINATION MITIGATION METHOD BY CARBON STEEL PASSIVATION OF NUCLEAR SYSTEMS AND COMPONENTS

(71) Applicant: WESTINGHOUSE ELECTRIC COMPANY LLC, Cranberry Township, PA (US)

(72) Inventors: Darik J. Tippetts, Pasco, WA (US); Randall A. Duncan, Kennewick, WA (US); Cornelius A. Swift, Richland, WA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 836 days.

(21) Appl. No.: 15/438,080

(22) Filed: Feb. 21, 2017

(65) Prior Publication Data

US 2018/0237921 A1 Aug. 23, 2018

(51) Int. Cl.

| | |
|---|---|
| ***G21F 9/00*** | (2006.01) |
| ***C23C 22/78*** | (2006.01) |
| ***C23C 22/62*** | (2006.01) |
| ***C23F 11/04*** | (2006.01) |

(52) U.S. Cl.

CPC ..... *C23C 22/62* (2013.01); *C23C 22/78* (2013.01); *C23F 11/04* (2013.01); *G21F 9/004* (2013.01)

(58) Field of Classification Search

CPC ..... C23C 22/62; C23C 22/78; G21F 9/004

See application file for complete search history.

(56) References Cited

U.S. PATENT DOCUMENTS 3,248,269 A 4/1966 Bell
5,587,025 A * 12/1996 Jevec ..... C23C 22/62 148/274
2009/0112042 A1 4/2009 Chung et al.
2011/0120497 A1 5/2011 Remark et al.
2012/0279522 A1* 11/2012 Varrin, Jr. ..... C02F 5/12 134/22.13

FOREIGN PATENT DOCUMENTS

WO 00/78403 A1 12/2000
WO 2007/001263 A2 1/2007

OTHER PUBLICATIONS

"Why recommend ammoniated citric acid for the chemical cleaning of high pressure boilers", http://www.angelfire.com/mt/chemicalcleaning/webboiler.html, Feb. 20, 2017, pp. 1-5.

T. van Os, "The Passivation of Steel", Vecom, Technical Bulletin, Oct. 2005, pp. 1-2, No. 2005/17.

K. Dibble, "Chemical Cleaning of Metals", VIII-Metals-H-Cleaning, http://nzic.org.nz/chemprocesses/metals/8H.pdf, pp. 1-9.

H. Ocken, "Decontamination Handbook", TR-112352, Final Report, Jul. 1999, pp. xv-xx, 4-1 to 4-6 and 12-1 to 12-17, EPRI Licensed Material, Copyright 1999—Electric Power Research Institute, Inc.

International Search Report and Written Opinion of the International Searching Authority for PCT/US2018/017903 dated May 21, 2018 (Forms PCT/ISA/220, PCT/ISA/210 and PCT/ISA/237).

* cited by examiner

*Primary Examiner* — Lois L Zheng

(74) *Attorney, Agent, or Firm* — K&L Gates LLP

(57) ABSTRACT

The invention relates to methods for mitigating the recontamination of carbon steel surfaces in a nuclear reactor or related water-containing systems and components, which have undergone a decontamination process. The methods include conducting a passivation process of the carbon steel surfaces directly following completion of the decontamination process, prior to the system or component being returned to service. In certain embodiments, a chelating agent is used in the decontamination process and is retained following completion of the process, for use in the subsequent passivation process. The passivation process forms a passivation film that is effective to reduce recontamination of the decontaminated carbon steel surfaces.

15 Claims, No Drawings

RECONTAMINATION MITIGATION METHOD BY CARBON STEEL PASSIVATION OF NUCLEAR SYSTEMS AND COMPONENTS

BACKGROUND

Field

This invention relates to methods for the passivation of metallic surfaces, more particularly, metallic surfaces, such as carbon steel, which have been exposed to a decontamination process in a water-containing system of a nuclear reactor.

Background Information

Most metallic surfaces which are exposed to hot water become corroded and develop a layer of metal oxide film. If this oxide film is formed in water containing radioactive species, or is otherwise exposed to water containing radioactive species, the radioactive species can become trapped in the corrosion layer. The accumulation of radioactive material on the internal surfaces of piping, tubing and components of a water coolant system in a nuclear reactor can produce undesirable radiation fields, which present a serious hazard to maintenance workers. The radioactive material can be removed by decontamination. Decontamination is generally defined as the removal of contamination from surfaces by washing, heating, chemical or electrochemical action, and mechanical action. Decontamination can be effective to remove the contamination, e.g., radioactive material, from components to reduce dose level. A usual method of removing this hazardous material is to employ an aqueous decontaminating solution, i.e., a chemical solution which will dissolve and/or loosen the contaminated oxide layer, and flush the dissolved or loosened materials from the system. This process is commonly referred to as chemical decontamination.

The type of oxide formed on a metallic surface by the corrosion process depends upon the particular alloy of the metal component, and the chemical conditions in the water. With the proper selection of chemicals, almost all metal oxide films containing radionuclides may be removed from metallic surfaces using a decontamination process. A further advantage is that chemical decontamination allows the treatment of complex surface geometry. The main disadvantage of chemical decontamination, however, is the generation of secondary liquid waste which requires appropriate processing for final treatment and conditioning.

Following decontamination, the decontaminated metallic surfaces are then re-exposed and in contact with cooling water, which originally caused the surfaces to become corroded and develop a metal oxide film. In the absence of a mitigating process, the decontaminated metallic surfaces are re-contaminated and re-develop the metal oxide film with radioactive materials contained therein. Thus, there is a need in the art to provide methods for mitigating the re-contamination of decontaminated metallic surfaces. The invention provides a method of mitigation that includes forming a passivation film on the decontaminated metallic surface directly following completion of the decontamination process. The mitigation method is performed while the decontaminated system or component is out of service. This passivation process can be conducted using a chemical solvent that was previously utilized in the decontamination process. The re-use of solvent is advantageous to reduce or minimize secondary waste that can be produced by the decontamination and passivation processes. Generally, decontamination and passivation techniques produce secondary waste, such as abrasive particles, liquid effluents, fumes and aerosols. Methods to control the production of this waste material is important since it can influence worker safety (e.g., production of aerosols, handling of this waste, and the like), and impact waste management (more waste that requires disposal). Further, in decontamination and passivation processes the final wastes are concentrated and therefore, represent a significant radiation source.

SUMMARY

In one aspect, the invention provides a method for mitigating recontamination of a decontaminated carbon steel surface in a water-containing system or component of a nuclear reactor. The method includes performing a decontamination of an oxide-containing carbon steel surface in the water-containing system or component, which includes removing the water-containing system or component from operation, adding a decontamination solvent to the water-containing system or component to contact the oxide-containing carbon steel surface, wherein the decontamination solvent includes a chelating agent, and removing oxide from the oxide-containing carbon steel surface to produce the decontaminated carbon steel surface. The method further includes, following performing of the decontamination and prior to returning the water-containing system or component to operation, providing a passivation solvent in the water-containing system or component; adding caustic and oxidant to the passivation solvent to form a passivation solution; inducing passivation and forming a passivation film on the decontaminated carbon steel surface; returning the water-containing system or component to operation; and as a result of forming the passivation film, reducing the re-growth of oxide on the decontaminated carbon steel surface. The decontamination solvent and the passivation solvent are the same or different and when the same, the decontamination solvent optionally remains in the water-containing system or component following decontamination for re-use in subsequent passivation.

The chelating agent can include citric acid. In certain embodiments, the chelating agent is selected from the group consisting of citric acid, ethylenediaminetetraacetic acid (EDTA), nitrilotriacetic acid (NTA), ascorbic acid, picolinic acid, ethylenediamine (EDA), and mixtures thereof. Further, in certain embodiments, the chelating agent is present in an amount that constitutes from about 0.5 g/L to about 2.0 g/L of the passivation solution, or about 1.75 g/L of the passivation solution.

The solvent can include oxalic acid and citric acid. In certain embodiments, the oxalic acid is present in an amount that constitutes from about 0.2 g/L to about 0.75 g/L of the passivation solution.

The caustic can include ammonium hydroxide. In certain embodiments, the caustic is selected from the group consisting of ammonium hydroxide, sodium hydroxide, sodium bicarbonate, hydrazine, ethylenediamine (EDA), and mixtures thereof. Further, in certain embodiments, the caustic is present in an amount that is sufficient to increase pH of the passivation solution, such as, to a range from about 9 to about 9.5.

The oxidant can include hydrogen peroxide. In certain embodiments, the chelating agent is selected from the group consisting of hydrogen peroxide, ozone, oxygen, potassium permanganate, sodium nitrite, and mixtures thereof. Further, in certain embodiments, the oxidant is present in an amount that is sufficient to achieve an oxidation reduction potential (ORP) of greater than 0 mV SCE in the passivation solution.

DESCRIPTION OF THE PREFERRED EMBODIMENTS

The invention relates to methods for mitigating, e.g., reducing, recontamination of carbon steel systems and components following decontamination, e.g., a chemical decontamination process, in a nuclear reactor and related water-containing systems. Further, the invention provides for resistance to flow-assisted corrosion. Directly, e.g., immediately, following completion of the decontamination process, a passivation process is initiated to form a passivation film on the decontaminated surfaces of the carbon steel systems or components. The decontamination and passivation processes utilize a chelating agent. Thus, in certain embodiments, upon completion of the decontamination process, the chelating agent remains in the system or component and is subsequently used in the passivation process. The passivation process is conducted following the decontamination process while the decontaminated system or component is out of service and prior to returning it to service. Further, the decontamination and passivation processes can be performed while the nuclear reactor is operation, or while shutdown and prior to commencing its operation. In certain embodiments, the passivation process is initiated immediately upon completion of the decontamination process.

It is usual for carbon steel surfaces in water-containing systems and components of a nuclear reactor to experience corrosion as a result of their contact with the water. During operation of the nuclear reactor, oxide is deposited on the carbon steel surfaces and an oxide film develops. Due to the environment of the system or component, the oxide film can contain radionuclides and other contaminants. Removal of the oxide film and the contaminants, e.g., radioactive materials, contained therein is needed for various reasons. For example, decontamination reduces the risk of dose exposure to plant personnel and increases the reliability and life of the system or component to perform its function. A typical decontamination process includes taking the component or system to be decontaminated out of service. The nuclear reactor can be operating or not operating, such as during a refueling shutdown of the nuclear reactor.

Further, the decontamination process includes adding chemicals to the component or system, or part(s) thereof, for removal of the oxide film and contaminants. Typically, the chemicals used in the chemical decontamination process are effective to substantially remove the oxide film and to expose the bare surface of the system or component. However, when the system or component is returned to service and the nuclear reactor is operating, the decontaminated (clean) metallic, e.g., carbon steel, surfaces are re-exposed and in contact with water and associated contaminants, and susceptible to recontamination, e.g., re-development of an oxide film, and flow-assisted corrosion.

It has been found that the decontaminated surface initially experiences rapid corrosion and starts to reform the oxide film. The bare metal surface quickly corrodes. After an extended time period, e.g., a couple of years, the oxide film is mature and additional growth is significantly slower. A significant portion of the contaminants, e.g., radioactive material, incorporated into the oxide film occurs during the initial period of rapid growth of the film. The more rapid the film growth, the more rapid the incorporation of contaminants. Without intending to be bound by any theory, it is estimated that about fifty percent of the oxide film will re-develop in the first two or three months after the decontaminated surface is re-exposed to water. During this time of rapid re-growth, the nuclear plant is typically experiencing a change of flows and chemistry associated with performing outage activities and restarting the nuclear reactor. During these changes, radioactive material and contaminants are being moved in the plant, such that the period of time when the oxide film is most vulnerable to incorporation of radionuclides and contaminants, the levels of these radionuclides and contaminants in the cooling water are at their peak. As a result, it has been found that it is typical for the dose rates associated with the decontaminated carbon steel surfaces of the system or component to return to levels near those that existed prior to conducting the decontamination process.

In accordance with the invention, directly following the decontamination process, i.e., prior to returning the system or component to service, an initial passivation film is created on the carbon steel surface to essentially preclude the initial rapid formation of an oxide film on the decontaminated, e.g., bare, surface of the carbon steel system or component when it is re-exposed to water following its return to service and during operation of the nuclear reactor. The presence of the passivation film can reduce or preclude the formation of the oxide film during the initial rapid oxide growth period, when the decontaminated surface of the system or component is initially returned to service. The oxide film develops on a passivated metal surface slower as compared to the development of an oxide film on a bare metal surface. The passivation film is effective to retard the growth of the oxide film. Thus, when the radionuclide and contaminate level in the water is high, the growth rate of the oxide film is slowed and as a result, a lower concentration of radionuclides and contaminants are incorporated into the film. Thus, the passivation film can effectively slow corrosion, and a slower corrosion rate results in slower uptake of the radionuclides and contaminants in the cooling water.

Chemical decontamination of the carbon steel surface of the water-containing system or component includes the use of a solvent, such as, CITROX organic acids, to effectuate removal of oxide film from the surfaces. CITROX is a mixture of citric acid, e.g., a chelating agent, and oxalic acid. Typically, upon completion of the chemical decontamination process, the solvent is removed from the system or component for disposal. However, in certain embodiments of the invention, directly following completion of the decontamination process, the CITROX remains in the system or component for use in the subsequent passivation process.

The citric acid in the CITROX serves as the chelating agent in the passivation process. At the termination of the CITROX decontamination, the citric acid concentration is from about 0.5 g/L to about 2.0 g/L or about 1.75 g/L, oxalic acid is from about 0.2 g/L to about 0.5 g/L, and dissolved iron is from about 20 to about 100 ppm. The chelating agent, e.g., citric acid, prevents precipitation of metal hydroxides. Chemical decontamination is typically performed at a temperature of about 200° F. The application temperature for passivation is in a range of about 140° F. to 160° F. Thus, following decontamination, the decontaminated system or component is allowed to cool to the application temperature of the passivation. In certain embodiments, process heaters are turned off and the CITROX solvent is allowed to cool to approximately 60° C.

For ease of description, a CITROX solvent is primarily recited throughout this disclosure. However, it is contemplated and understood that a decontamination solvent other than CITROX and a chelating agent other than citric acid may be used. For example, suitable alternative chelating agents may include ethylenediaminetetraacetic acid (EDTA), nitrilotriacetic acid (NTA), ascorbic acid, picolinic acid, ethylenediamine (EDA), and mixtures thereof. Suitable solvents may include any decontamination solvent that can be subsequently removed by a separation process, such as, ion exchange. Further, as previously indicated, the decontamination solvent/chelating agent can also be used as the passivation solvent/chelating agent. However, as an alternative, the decontamination solvent/chelating agent can be removed from the decontaminated system or component, and another, e.g., new, solvent/chelating agent may be used in the passivation process. The new solvent/chelating agent may be the same or different from the solvent/chelating agent used in the decontamination process.

A passivation solution is created by adding a caustic component and an oxidant to the CITROX solvent. Suitable caustic components for use in the invention are known in the art, and include ammonium hydroxide, sodium hydroxide, sodium bicarbonate, hydrazine, ethylenediamine (EDA), and mixtures thereof. The amount of caustic component can vary. Typically, the amount of caustic component, e.g., ammonium hydroxide, is such as to increase the pH of the passivation solution. In certain embodiments, the caustic component is added in an amount sufficient to achieve a passivation solution having an alkaline pH from about 9 to about 9.5.

The oxidant is added to the CITROX solvent to oxidize the base carbon steel surface and induce a passivation film on the carbon steel surface. Suitable oxidants for use in the invention are known in the art, and include hydrogen peroxide, ozone, oxygen, potassium permanganate, sodium nitrite, and mixtures thereof. The amount of oxidant can vary. Typically, the amount of oxidant is such as to achieve an oxidation reduction potential (ORP) of greater than 0 mV SCE.

Without intending to be bound by any particular theory, it is believed that the oxidant, e.g., hydrogen peroxide, is reacted and the passivation is completed, with any excess peroxide being allowed to decompose. Any remaining residual chemicals, which may include radionuclides, are then removed by a conventional separation process, such as but not limited to, ion exchange.

In certain embodiments, hydrogen peroxide is a preferred oxidant because it can be converted to gas and removal by resin is not required, which provides savings in the cost of radioactive waste disposal.

In the nuclear industry, secondary waste production and the methods for handling secondary wastes are costly. Therefore, it is desirable to minimize the amount of secondary waste produced in general and, more particularly, produced as a result of performing chemical decontamination of systems or components, and the subsequent passivation of carbon steel surfaces according to the invention. In order to minimize the production of secondary waste, as mentioned previously herein, it is preferred to retain the decontamination solvent in the system or component (instead of disposing of it following the decontamination process) for re-use in the passivation solution. The decontamination process solvent is transformed directly into the passivation solution, i.e., without additional solvent/chelating agent being necessary. Further, the concentration of the secondary waste is lower because the concentration of chemicals used in the passivation process of the invention are more dilute, as compared to the concentration of chemicals used in traditional passivation processes. In certain embodiments of the invention, the passivation solution includes from about 0.5 to about 2.0 g/L of chelating agent, e.g., citric acid, or about 1.75 g/L of chelating agent, e.g., citric acid (which corresponds to a pH of about 2.5).

In comparison, traditional passivation methods can employ as much as ten times more chelating agent for use with a non-nuclear system or component, such as the removal of rust from a metal surface due to exposure to air. For example, in a boiler system, a typical non-nuclear system, citric acid may be used in an amount that is effective to dissolve a large amount of iron. In contrast, in accordance with the invention, iron contaminants can be removed during chemical decontamination and therefore, a large amount of citric acid is not required during the passivation process to sequester iron. A lower concentration and/or amount of chelating agent results in advantages for disposal and handling of secondary wastes.

Moreover, it has been found that a presence of oxalic acid in the passivation solution, e.g., as a result of being combined with citric acid in the CITROX decontamination solvent, can allow for using reduced amounts of caustic agent, e.g., ammonium hydroxide, and oxidant, e.g., hydrogen peroxide. The oxalic acid also catalyzes the reaction to increase the oxidation process and the consumption of any excess oxidant.

The invention provides methods that are effective for reducing, e.g., slowing down or retarding, post-chemical decontamination uptake and incorporation of radioactive material into a developing oxide film on carbon steel surfaces of the nuclear reactor and related water-containing systems, and flow-assisted corrosion.

While the invention has been described in terms of various specific embodiments, those skilled in the art will recognize that the invention can be practiced with modifications within the spirit and scope of the appended claims.

What is claimed is:

1. A method for mitigating recontamination of a decontaminated carbon steel surface in a water-containing system or component of a nuclear reactor, comprising:

performing decontamination of a radionuclide-containing oxide film deposited on a carbon steel surface in the water-containing system or component, comprising:

removing the water-containing system or component from operation;

adding to the water-containing system or component a decontamination solvent to contact the radionuclide-containing oxide film on the carbon steel surface, the decontamination solvent comprising a chelating agent; and removing the radionuclide-containing oxide film on the carbon steel surface to produce the decontaminated carbon steel surface;

following the decontamination and prior to returning the water-containing system or component to operation, using the decontamination solvent that is remaining from the decontamination in a subsequent passivation process;

conducting the passivation process, comprising:

cooling the water-containing system or component and decontamination solvent to a passivation temperature of about 140° F. to 160° F.;

adding caustic and oxidant to the decontamination solvent that is remaining to form a passivation solution;

inducing passivation of the water-containing system or component with the passivation solution; and forming a passivation film on the decontaminated carbon steel surface; returning the water-containing system or component to operation; and as a result of the passivation film, reducing the re-growth of a radionuclide-containing oxide film on the decontaminated carbon steel surface when the water-containing system or component is returned to operation.

2. The method of claim 1, wherein the chelating agent is citric acid.

3. The method of claim 2, wherein the decontamination solvent further comprises oxalic acid.

4. The method of claim 3, wherein the oxalic acid is present in an amount that constitutes from about 0.2 g/L to about 0.5 g/L of the passivation solution.

5. The method of claim 1, wherein the chelating agent is selected from the group consisting of citric acid, ethylenediaminetetraacetic acid (EDTA), nitrilotriacetic acid (NTA), ascorbic acid, picolinic acid, ethylenediamine (EDA), and mixtures thereof.

6. The method of claim 1, wherein the caustic comprises ammonium hydroxide.

7. The method of claim 1, wherein the caustic is selected from the group consisting of ammonium hydroxide, sodium hydroxide, sodium bicarbonate, hydrazine, ethylenediamine (EDA), and mixtures thereof.

8. The method of claim 1, wherein the oxidant comprises hydrogen peroxide.

9. The method of claim 1, wherein the oxidant is selected from the group consisting of hydrogen peroxide, ozone, oxygen, potassium permanganate, sodium nitrite, and mixtures thereof.

10. The method of claim 1, wherein the chelating agent is present in an amount that constitutes from about 0.5 g/L to about 2.0 g/L of the passivation solution.

11. The method of claim 1, wherein the chelating agent is present in an amount that constitutes about 1.75 g/L of the passivation solution.

12. The method of claim 1, wherein the amount of caustic added to the decontamination solvent is sufficient to increase pH of the passivation solution resulting therefrom.

13. The method of claim 12, wherein the pH is in a range from about 9 to about 9.5.

14. The method of claim 1, wherein the amount of oxidant added to the solvent is sufficient to achieve an oxidation reduction potential (ORP) of greater than 0 mV SCE in the passivation solution.

15. A method of employing a decontamination solvent to decontaminate and passivate a carbon steel surface in a water-containing system or component of a nuclear reactor, comprising:

decontaminating the carbon steel surface containing a radionuclide-containing oxide deposit, comprising:

removing the water-containing system or component from operation;

adding to the water-containing system or component a decontamination solvent comprising a chelating agent, to contact the radionuclide-containing oxide deposit on the carbon steel surface; and removing the radionuclide-containing oxide deposit from the carbon steel surface to produce a decontaminated carbon steel surface;

following decontamination, prior to removing the decontamination solvent from the water-containing system or component and prior to returning the water-containing system or component to operation, conducting a passivation process that comprises:

cooling the water-containing system or component and decontamination solvent to a passivation temperature of about 140° F. to 160° F.;

adding caustic and oxidant to the decontamination solvent retained in the water-containing system or component to form a passivation solution; and inducing passivation and forming a passivation film on the decontaminated carbon steel surface; and returning the water-containing system or component to operation; and as a result of the passivation film, reducing the re-growth of a radionuclide-containing oxide film on the decontaminated carbon steel surface when the water-containing system or component is returned to operation.

* * * * *